United States Patent [19]

Hamacher

[11] 3,999,057

[45] Dec. 21, 1976

[54] LIGHTING STRUCTURE

[76] Inventor: Martin Hamacher, Nimrodstr. 47, 4352 Herten, Germany

[22] Filed: Mar. 3, 1975

[21] Appl. No.: 554,622

[52] U.S. Cl. ..... 240/51.11 R; 240/51.12

[51] Int. Cl.[2] ..... H05B 33/02

[58] Field of Search ..... 240/51.11 R, 51.12, 240/41.55, DIG. 3, 11.4 R

[56] References Cited

UNITED STATES PATENTS

| | | | |
|---|---|---|---|
| 2,847,561 | 8/1958 | Huerkamp et al. | 240/51.11 R |
| 3,145,933 | 8/1964 | Dickson | 240/41.55 |
| 3,168,987 | 2/1965 | Heisler | 240/51.11 R |
| 3,302,059 | 1/1967 | Haire | 240/51.11 R |

*Primary Examiner*—Stephen J. Tomsky
*Attorney, Agent, or Firm*—Allegretti, Newitt, Witcoff & McAndrews

[57] ABSTRACT

The lighting structure disclosed is particularly useful for operational areas where the reflection is poor and which are subject to the risk of explosion and fire damp. The novel lighting structure comprises a casing containing power supply means and a fluorescent tube. The power supply means is a constant current transformer with power factor compensation and a rubber-like mass encases the transformer and tube connector terminals to conceal all live electrical parts except for the light emitting portion of the tube.

4 Claims, 2 Drawing Figures

LIGHTING STRUCTURE

BACKGROUND OF THE INVENTION

The invention relates to a lighting or lantern structure, especially for work areas where the reflection is poor, the light structure having a casing containing a power supply part and a fluorescent tube.

Hitherto for this purpose glow lamp lights were installed, which have however a relatively low light output in addition to the disadvantage of high temperature development. On physical grounds it is essential to give to these lighting structures relatively large and bulky dimensions. The short working life of glow lamps stipulates a relatively frequent exchange of the light source of the lighting structure; this again leads to high maintenance costs and also to sources of error which result from the exchange. On technical production grounds it is not possible to make extremely shock-resistant glow lamps, which at the same time give a steady signal.

In addition, lighting structures are also employed in which commercially available fluorescent lamps serve as light sources, which on the basis of the but few standardised lamps which can be commercially employed, necessitates having very large dimensions for the lighting structure itself. A further disadvantage of this type of lamp resides in that the fluorescent lamp does not give a steady signal, has a small working life dependent upon the percentage of time and use and in addition is not very shock-proof.

SUMMARY OF THE INVENTION

The problem underlying the invention consists in creating a spark proof lighting structure which is small in its dimensions, for the lighting of work areas which have poor reflection, especially in the mine workings of coal pits.

This problem is solved in accordance with the invention in that the power supply part includes a constant current transformer with power factor compensation and that the constant current transformer and the fluorescent tube are cast in the casing with a rubber-like mass in such a way that the mass covers, with the exception of the light emitting portion of the tube, all live parts of the lighting structure.

Preferably the emission of light is ensured by means of a pressure-resistant and impact-resistant protective disc which is pressed against the casing by means of a metal frame and is welded to it.

The essential advantage of this construction according to the invention resides in that the lighting structure can be employed in compact smaller construction in operating areas subject to the risk of explosion and fire damp. The lighting structure has, in addition to extreme electrical safety and mechanical resistivity, a high light efficiency and a working life which is long and independent of the percentage of time in use. Also the lighting structure according to the invention is very shock-proof, practically free from maintenance and easy to handle, wherein low operational temperatures prevail inside and outside the casing. In addition to small electrical connected load and full compensation, a high light efficiency of the lamp and lighting fitting is guaranteed, which again leads to correspondingly high intensity of illumination. The lighting structure is also watertight and its shape so designed that within the framework of an assembly of a prefabricated system light units can be combined into larger lighting systems.

The fluorescent tube subject to risk of fracture with usual fittings is made shock-proof, since its terminals which are electrically connected with the power supply unit in the interior of the casing are embedded in the rubber-like mass. This rubber-like mass is at the same time a gas pressure-tight jacket for all live parts of the lighting device. In addition, this rubber-like mass on the basis of the high electrical insulation value and temperature stability gives the essential electrical security. For specially high operational security the light exit opening is provided with a light permeable mechanically stable connection.

Through the permanently resilient condition of the rubber-like mass a continuous shock dampening and resilient suspension of the fluorescent tube terminals is ensured. This mass embraces the terminal electrodes of the fluorescent tube at the same time in a seamless and jointless manner so that in the case of defects no ignition spark takes place nor can enter from outside. The formation of such sparks is also diminished in that the rubber-like mass possesses an electrically high insulation value, so that between the live parts of the lighting device and the metal casing no electrical discharge can result.

The fluorescent tube is physically a low-pressure mercury lamp in which, in contrast to the glow lamp, no part of the whole fluorescent tube assumes so high a temperature which can lead to the starting of explosions. The design of the electrode in the form of a cup-shaped electrode or specially stable coil electrode ensures in addition an extremely strong resistance to shock. Such fluorescent tubes ignite immediately, they follow practically without delay the electrical impulse, so that an unconditional signal steadiness is given. In addition, these fluorescent tubes have the great advantage of possessing a high working life practically independent of the percentage of time of use, which working life lies within the order or magnitude of ten times the working life of the usual glow lamps. Furthermore, such fluorescent tubes are electrically relatively insensitive to increases and decreases of voltage. A voltage increase of 10% for example reduces the working life of the usual glow lamp by about 50%.

The constant current transformer provided according to the invention also possesses the advantage that in the case of a short circuit it has no higher current than the operating current of the lamp, which again is in practice determined only from the primary side of the input voltage. Accordingly the constant current transformer in contrast to the hitherto usual leak-field transformer can be rated smaller in its windings, which again leads to a small compact model. A constant current transformer with preferably secondary side series-resonance has at the same time the advantage that it has in the case of operation performance a power factor of about 1, so that it does not require to be additionally compensated.

The protection against explosion is also secured through the sealing compound since no conductive parts can produce spark-producing connections.

The invention is described below in more detail with regard to the illustrative embodiment shown in the accompanying drawing wherein:

FIG. 1 is a plan view of an illustrative lighting structure embodying the invention; and FIG. 2 is a sectional view on the line A—A of FIG. 1.

DESCRIPTION OF THE PREFERRED EMBODIMENT

Figure 1:
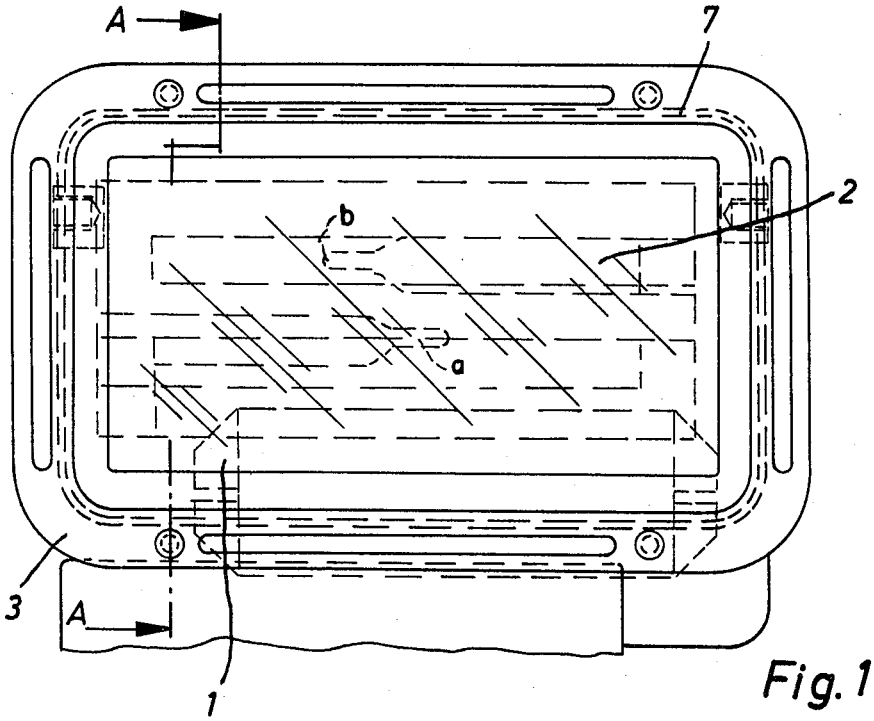
Figure 2:
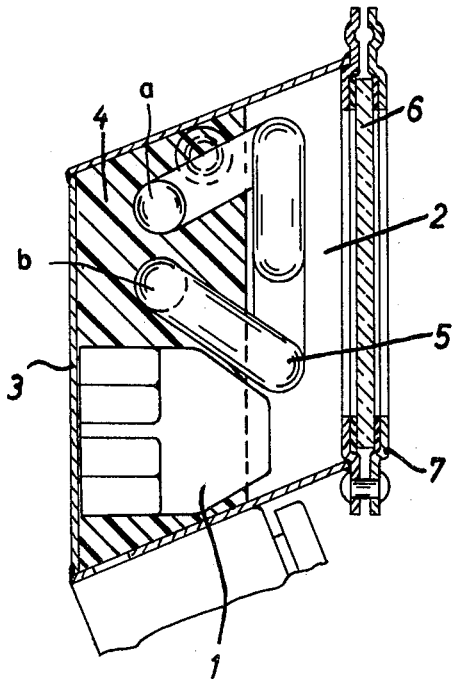

As shown in the drawing there is provided in a casing 3 the power supply part, which comprises a constant current transformer 1 with power factor compensation and a fluorescent tube 2. The constant current transformer 1 and the connector terminals a and b of the fluorescent tube 2 are embodied in a rubber-like mass 4 which conceals all the live parts of the light fixture with the exception of the light emitting portion of the tube. Accordingly the security against shock and impact of the fluorescent tube itself is ensured in the greatest loading. The light emitting opening is protected by a strong protection disc 6 adapted to withstand a shock stress of more than 100 Nm (Newtonmeter), and which is pressed against the case 3 by a metal frame 7 welded to it.

Because of the small measurements, the simple shape and the different variation possibilities of the lighting structure no mounting problems are encountered even with movable fixture devices. The installation of the light fixture support is specially applicable to operational areas liable to the risk of explosion, to dampness, having poor reflection and subjected to strong mechanical stresses.

While there is shown and described a preferred embodiment of the invention, it is to be distinctly understood that the invention is not limited thereto, but may otherwise be variously embodied and practiced within the scope of the following claims.

What is claimed is:

1. A lighting structure, especially for operational areas having poor reflection, having a casing containing power supply means and a fluorescent tube, said power supply means comprising a constant current transformer with power factor compensation, a rubber-like mass encasing said constant current transformer and the connector terminals of the fluorescent tube such that said mass conceals all live parts of the light fixture with the exception of the light emitting portion of the tube.

2. A lighting structure according to claim 1 wherein the light emission is protected by means of a pressure-resistant and impact-resistant protection disc, which disc is pressed against the casing by a metal frame and fastened to it.

3. A lighting structure according to claim 1, wherein said fluorescent tube is a cold cathode tube.

4. A lighting structure according to claim 3, wherein said fluorescent tube is an incandescent cathode tube without preheating.

* * * * *